US011965681B2

(12) United States Patent
Stark et al.

(10) Patent No.: US 11,965,681 B2
(45) Date of Patent: Apr. 23, 2024

(54) REFRIGERATION SYSTEM AND THE LUBRICATION METHOD THEREOF

(71) Applicant: Carrier Corporation, Palm Beach Gardens, FL (US)

(72) Inventors: Michael A. Stark, Mooresville, NC (US); Hsihua Li, Huntersville, NC (US); Haitao Zhang, Shanghai (CN); Biao Shu, Shanghai (CN); Kai Deng, Shanghai (CN); Haiping Ding, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 223 days.

(21) Appl. No.: 16/332,903

(22) PCT Filed: Aug. 28, 2017

(86) PCT No.: PCT/US2017/048852

§ 371 (c)(1),
(2) Date: Mar. 13, 2019

(87) PCT Pub. No.: WO2018/052694

PCT Pub. Date: Mar. 22, 2018

(65) Prior Publication Data

US 2019/0257302 A1 Aug. 22, 2019

(30) Foreign Application Priority Data

Sep. 14, 2016 (CN) ..... 201610823122.X

(51) Int. Cl.
*F25B 31/00* (2006.01)
*F25B 49/02* (2006.01)

(52) U.S. Cl.
CPC ..... *F25B 31/002* (2013.01); *F25B 31/004* (2013.01); *F25B 49/02* (2013.01);
(Continued)

(58) Field of Classification Search
CPC ..... F25B 31/002; F25B 31/004; F25B 49/02; F25B 2500/16; F25B 2500/26;
(Continued)

(56) References Cited

U.S. PATENT DOCUMENTS 2,986,905 A 6/1961 Kocher et al.
3,112,618 A 12/1963 Weller
(Continued)

FOREIGN PATENT DOCUMENTS

CN 102155429 A 8/2011
CN 204612318 U 9/2015
(Continued)

OTHER PUBLICATIONS

International Search Report and Written Opinion for application PCT/US2017/048852, dated Dec. 13, 2017, 16 pages.

*Primary Examiner* — Tavia Sullens
(74) *Attorney, Agent, or Firm* — CANTOR COLBURN LLP

(57) ABSTRACT

A refrigeration system and a lubricating method thereof. The refrigeration system (100) includes: a compressor (110), a condenser (120), an evaporator (130), and a lubrication circuit (200), the lubrication circuit including a post-lubrication flow path (230,240,260) connected from the compressor into the condenser and the evaporator respectively; and a pre-lubrication flow path (210,220,250) connected from the condenser and the evaporator into the compressor respectively; wherein after flowing from the condenser via the pre-lubrication flow path to the compressor for lubrication, a part of refrigerant for lubrication can flow back to the evaporator via the post-lubrication flow path; or after flowing from the evaporator via the pre-lubrication flow path to
(Continued)

the compressor for lubrication, the part of refrigerant for lubrication can flow back to the condenser via the post-lubrication flow path.

14 Claims, 6 Drawing Sheets

(52) U.S. Cl.
CPC ... *F25B 2339/0242* (2013.01); *F25B 2500/16* (2013.01); *F25B 2500/26* (2013.01); *F25B 2600/01* (2013.01); *F25B 2600/05* (2013.01); *F25B 2700/04* (2013.01)

(58) Field of Classification Search
CPC ..... F25B 2600/01; F25B 2600/05; F25B 2700/04; F25B 2700/03
See application file for complete search history.

(56) References Cited

U.S. PATENT DOCUMENTS

| | | | | |
|---|---|---|---|---|
| 3,158,009 | A | 11/1964 | Rayner | |
| 3,200,603 | A * | 8/1965 | Wake | F25B 31/002 62/84 |
| 3,500,962 | A * | 3/1970 | Kocher | F25B 31/002 184/103.1 |
| 3,673,811 | A * | 7/1972 | Adams | F25B 31/002 62/158 |
| 5,050,389 | A | 9/1991 | Wigmore et al. | |
| 5,088,292 | A | 2/1992 | Champagne et al. | |
| 5,881,564 | A | 3/1999 | Kishimoto et al. | |
| 5,884,498 | A | 3/1999 | Kishimoto et al. | |
| 6,035,651 | A * | 3/2000 | Carey | F04C 28/06 62/115 |
| 6,065,297 | A | 5/2000 | Tischer et al. | |
| 6,098,422 | A | 8/2000 | Tischer | |
| 6,434,960 | B1 | 8/2002 | Rousseau | |
| 6,564,560 | B2 | 5/2003 | Butterworth et al. | |
| 6,708,521 | B2 | 3/2004 | Wurth | |
| 6,755,039 | B2 | 6/2004 | Tsuboi | |
| 7,591,147 | B2 | 9/2009 | Masoudipour et al. | |
| 8,104,298 | B2 | 1/2012 | Sishtla | |
| 8,156,757 | B2 | 4/2012 | Doty et al. | |
| 8,397,534 | B2 | 3/2013 | Doty et al. | |
| 8,424,339 | B2 | 4/2013 | Sommer | |
| 8,516,850 | B2 | 8/2013 | Jadric et al. | |
| 9,032,753 | B2 | 5/2015 | Love et al. | |
| 9,194,619 | B2 | 11/2015 | Margotti et al. | |
| 2006/0225447 | A1 | 10/2006 | Yamamoto et al. | |
| 2011/0194960 | A1 | 8/2011 | Wu et al. | |
| 2014/0360210 | A1 | 12/2014 | Lapp et al. | |
| 2015/0300708 | A1 | 10/2015 | Kennedy | |
| 2015/0362232 | A1 | 12/2015 | Jandal et al. | |
| 2016/0010691 | A1 | 1/2016 | Lapp et al. | |
| 2016/0040915 | A1 | 2/2016 | Jonsson et al. | |
| 2016/0047575 | A1 | 2/2016 | Jonsson et al. | |

FOREIGN PATENT DOCUMENTS

| | | | |
|---|---|---|---|
| EP | 0754861 | A2 | 1/1997 |
| EP | 0933603 | A1 | 8/1999 |
| EP | 0936422 | A2 | 8/1999 |
| EP | 2330176 | A1 | 6/2011 |
| WO | 0022359 | A1 | 4/2000 |
| WO | 2014179032 | A1 | 11/2014 |

* cited by examiner

REFRIGERATION SYSTEM AND THE LUBRICATION METHOD THEREOF

TECHNICAL FIELD

The present invention relates to the field of refrigeration, and in particular, to a refrigeration system and a lubricating method thereof.

BACKGROUND ART

In the field of refrigeration devices, these devices are usually lubricated to improve the service life of the devices and make the working process thereof smoother. The devices may be lubricated in many manners. For example, special lubricating oil may be filled into a system. In this case, despite the presence of an oil return system, it is inevitable that part of the lubricating oil is discharged into pipelines and a heat exchanger as the system runs, thus affecting the heat exchange performance of a refrigerant in some degree. Therefore, related researches are carried out on oil-free lubricating systems in the field. In such type of lubricating systems, part of the liquid refrigerant is extracted at a certain position of the refrigeration system and delivered to a compressor, so as to lubricate a bearing in the compressor. In this case, where to extract the refrigerant, when to extract the refrigerant, how much refrigerant is to be extracted for lubrication, and so on need to be considered. These are all problems needing to be considered during a process of lubricating the refrigeration system by using the refrigerant.

SUMMARY OF THE INVENTION

An objective of the present invention is to provide a refrigeration system that uses refrigerant for lubrication.

Another objective of the present invention is to provide a lubricating method of a refrigeration system, which uses a refrigerant for lubrication.

According to an aspect of the present invention, a refrigeration system is provided, including: a compressor, a condenser, an evaporator, and a lubrication circuit, the lubrication circuit including a post-lubrication flow path connected from the compressor into the condenser and the evaporator respectively; and a pre-lubrication flow path connected from the condenser and the evaporator into the compressor respectively; wherein after flowing from the condenser via the pre-lubrication flow path to the compressor for lubrication, a part of refrigerant for lubrication can flow back to the evaporator via the post-lubrication flow path; or after flowing from the evaporator via the pre-lubrication flow path to the compressor for lubrication, the part of refrigerant for lubrication can flow back to the condenser via the post-lubrication flow path.

According to another aspect of the present invention, a lubricating method of a refrigeration system is further provided, wherein the refrigeration system includes a compressor, a condenser, an evaporator, and a lubrication circuit; the lubrication circuit includes a post-lubrication flow path connected from the compressor into the condenser and the evaporator respectively; and a pre-lubrication flow path connected from the condenser and the evaporator into the compressor respectively, wherein one or more of the following lubrication modes are executed based on a real-time working condition: a first lubrication mode, in which after flowing from the condenser via the pre-lubrication flow path to the compressor for lubrication, a part of refrigerant for lubrication is enabled to flow back to the evaporator via the post-lubrication flow path; and a second lubrication mode, in which after flowing from the evaporator via the pre-lubrication flow path to the compressor for lubrication, the part of refrigerant for lubrication is enabled to flow back to the condenser via the post-lubrication flow path.

According to still another aspect of the present invention, a refrigeration system is further provided, including: a compressor, a condenser, an evaporator, and a lubrication circuit, the lubrication circuit including a post-lubrication flow path connected from the compressor into the evaporator; and a pre-lubrication flow path connected from the condenser and the evaporator into the compressor respectively; wherein after flowing from the condenser via the pre-lubrication flow path to the compressor for lubrication, a part of refrigerant for lubrication can flow back to the evaporator via the post-lubrication flow path; or after flowing from the evaporator via the pre-lubrication flow path to the compressor for lubrication, the part of refrigerant for lubrication can flow back to the evaporator via the post-lubrication flow path.

According to further another aspect of the present invention, a lubricating method of a refrigeration system is further provided, wherein the refrigeration system includes a compressor, a condenser, an evaporator, and a lubrication circuit, the lubrication circuit including a post-lubrication flow path connected from the compressor into the evaporator; and a pre-lubrication flow path connected from the condenser and the evaporator into the compressor respectively, wherein one or more of the following lubrication modes are executed based on a real-time working condition: a first lubrication mode, in which after flowing from the condenser via the pre-lubrication flow path to the compressor for lubrication, a part of refrigerant for lubrication is enabled to flow back to the evaporator via the post-lubrication flow path; and a second lubrication mode, in which after flowing from the evaporator via the pre-lubrication flow path to the compressor for lubrication, the part of refrigerant for lubrication is enabled to flow back to the evaporator via the post-lubrication flow path.

DETAILED DESCRIPTION

Figure 1:
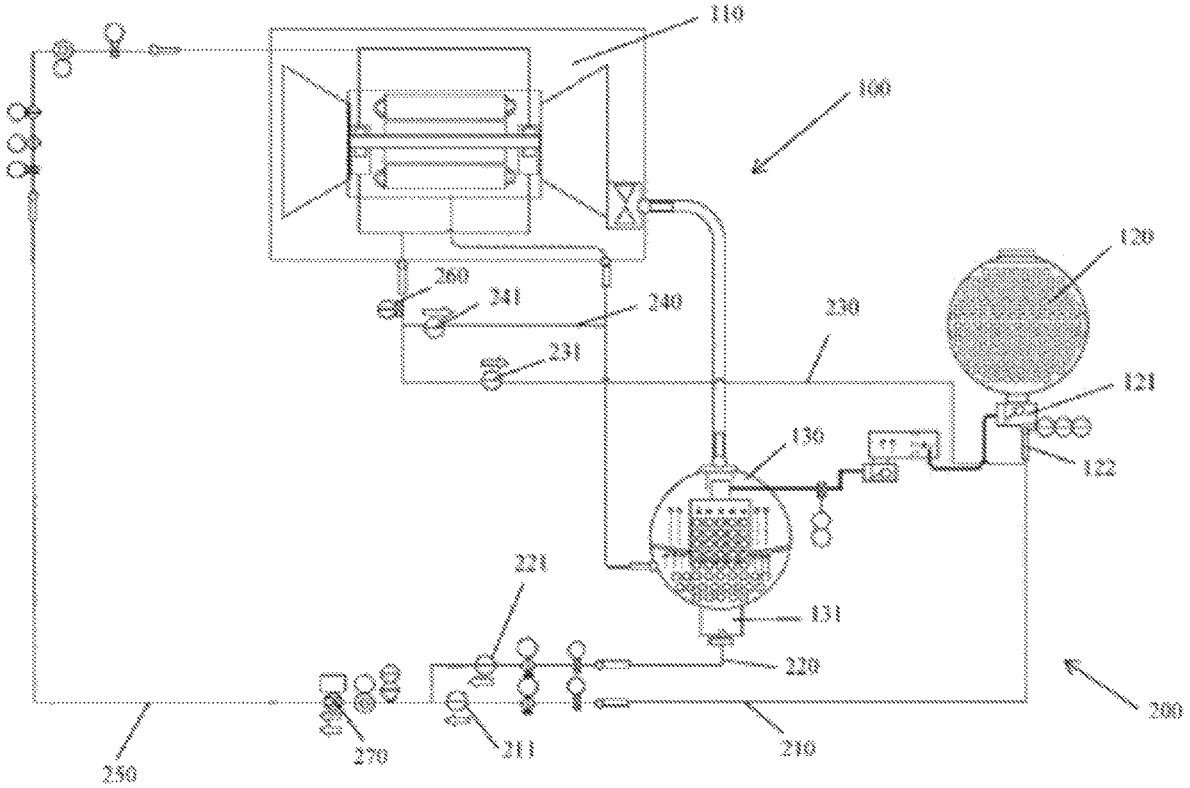
FIG. 1 is a schematic diagram of a refrigeration system according to an embodiment of the present invention.

FIG. 1 shows an embodiment of a refrigeration system 100. In order to emphasize the focus of the content of the disclosure conveniently, working pipelines among four major components of a conventional refrigeration system are omitted, and only partial pipelines and components related to lubrication in the refrigeration system are emphasized. Specifically, the refrigeration system 100 includes: a compressor 110, a condenser 120, an evaporator 130, and a lubrication circuit 200. The lubrication circuit 200 includes a post-lubrication flow path connected from the compressor 110 into the condenser 120 and the evaporator 130 respectively; and a pre-lubrication flow path connected from the condenser 120 and the evaporator 130 into the compressor 110 respectively. The lubrication circuit 200 can be partially conducted, so that after flowing from the condenser 120 via the pre-lubrication flow path to the compressor 110 for lubrication, part of refrigerant for lubrication can flow back to the evaporator 130 via the post-lubrication flow path; or after flowing from the evaporator 130 via the pre-lubrication flow path to the compressor 110 for lubrication, a part of refrigerant for lubrication can flow back to the condenser 120 via the post-lubrication flow path. In such an arrangement, part of refrigerant can be extracted from the evaporator 130 or the condenser 120 selectively according to an actual condition, to lubricate a bearing in the compressor 110. As an example, when the refrigerant is poured for the first time into a new machine, the refrigerant is usually poured into the evaporator 130. In this case, correspondingly, when the new machine is powered on for the first time, the refrigerant should be extracted from the evaporator 130 to lubricate the compressor 110, because there is no refrigerant present in the condenser 120 at this time. As another example, when the machine runs normally, the refrigerant should be extracted from the condenser 120 to lubricate the compressor 110, because the refrigerant in the evaporator 130 is mainly gaseous at this time. According to the disclosure of this embodiment, the bearing in the compressor can be sufficiently lubricated in various real-time working conditions, so that the whole machine can run in a very smooth state, and the service life and working reliability thereof can be improved.

The pre-lubrication flow path and the post-lubrication flow path for guiding the refrigerant between the compressor and a heat exchanger are mentioned in this embodiment. As for the specific implementation thereof, on/off control can be implemented by using multiple valves, or turning or channel diversion control can be implemented by using some three-way valves, or the guiding function can be implemented by using multiple flow channels. Specifically, in the drawing, the pre-lubrication flow path includes a first branch 210 connected to the condenser 120 and a second branch 220 connected to the evaporator 130; the post-lubrication flow path includes a third branch 230 connected to the condenser 120 and a fourth branch 240 connected to the evaporator 130. The lubrication circuit 200 can also be partially conducted, so that after flowing from the condenser 120 via the first branch 210 to the compressor 110 for lubrication, the part of refrigerant for lubrication can flow back to the evaporator 130 via the fourth branch 240; or after flowing from the evaporator 130 via the second branch 220 to the compressor 110 for lubrication, the part of refrigerant for lubrication can flow back to the condenser 120 via the third branch 230.

Optionally, to implement separate on/off control over the first branch 210, the second branch 220, the third branch 230, and the fourth branch 240, thereby implementing partial conduction control on the entire lubrication circuit 200, as a simple and easy-to-implement manner, the four branches may be provided with a first control valve 211, a second control valve 221, a third control valve 231, and a fourth control valve 241 respectively.

Optionally, the objective of implementing this idea does not necessarily require separate on/off control over multiple branches. From another aspect, it only requires that turning of branches can be implemented, a required flow path can be conducted, and a branch not required temporarily can be cut off. As an example meeting the foregoing requirement, the pre-lubrication flow path further includes a first common flow path 250 connected to the first branch 210 and the second branch 220 respectively, and a joint of the first branch 210, the second branch 220, and the first common flow path 250 is provided with a first three-way valve; the post-lubrication flow path includes a second common flow path 260 connected to the third branch 230 and the fourth branch 240 respectively, and a joint of the third branch 230, the fourth branch 240, and the second common flow path 260 is provided with a second three-way valve.

Optionally, the refrigeration system further includes a driving component 270 provided on the pre-lubrication flow path, to provide a power source for extracting the refrigerant. It should be noted that, when the driving component 270 is provided on the first common flow path 250, only one driving component 270 needs to be provided to meet working requirements under different working conditions. When the driving component 270 is provided on a branch, at least one driving component 270 needs to be provided on each of the first branch 210 and the second branch 220 to meet requirements of driving different branches under different working conditions.

Optionally, on one hand, the first branch 210 and the third branch 230 are connected to a liquid storage chamber 121 of the condenser 120. On the other hand, the second branch 220 is connected to a liquid storage chamber 131 of the evaporator 130; and the fourth branch 240 is connected to the bottom of the evaporator 130. All these elements are located at the bottom of the condenser 120 or the evaporator 130, and such an arrangement can facilitate extraction of the liquid refrigerant.

Optionally, the refrigeration system further includes a filter assembly arranged on the pre-lubrication flow path, so as to filter out impurities in the refrigerant flowing through the path, and avoid affecting precision components in the compressor 110.

Optionally, the refrigeration system further includes a liquid level switch 122 arranged in the liquid storage chamber 121 of the condenser 120, to provide monitoring data, thereby facilitating judging whether a current lubrication degree is applicable.

The lubricating method of the refrigeration system 100 shown in FIG. 1 can further improve the lubrication effect of the refrigeration system 100. One or more of the following lubrication modes are executed based on a real-time working condition. In a first lubrication mode, after flowing from the condenser 120 via the pre-lubrication flow path to the compressor 110 for lubrication, the part of refrigerant for lubrication is enabled to flow back to the evaporator 130 via the post-lubrication flow path; in a second lubrication mode, after flowing from the evaporator 130 via the pre-lubrication flow path to the compressor 110 for lubrication, the part of refrigerant for lubrication is enabled to flow back to the condenser 120 via the post-lubrication flow path. In this case, it is determined, according to the actual amount of the liquid refrigerant in the evaporator 130 or condenser 120 in the real-time working condition, where to extract the liquid refrigerant to lubricate the bearing in the compressor.

Specifically, in a specific piping layout, the pre-lubrication flow path includes a first branch 210 connected to the condenser 120 and a second branch 220 connected to the evaporator 130; the post-lubrication flow path includes a third branch 230 connected to the condenser 120 and a fourth branch 240 connected to the evaporator 130. The first lubrication mode includes: enabling the part of refrigerant for lubrication to flow back to the evaporator 130 via the fourth branch 240 after flowing from the condenser 120 via the first branch 210 to the compressor 110 for lubrication; the second lubrication mode includes: enabling the part of refrigerant for lubrication to flow back to the condenser 120 via the third branch 230 after flowing from the evaporator 130 via the second branch 220 to the compressor 110 for lubrication.

Figure 2:
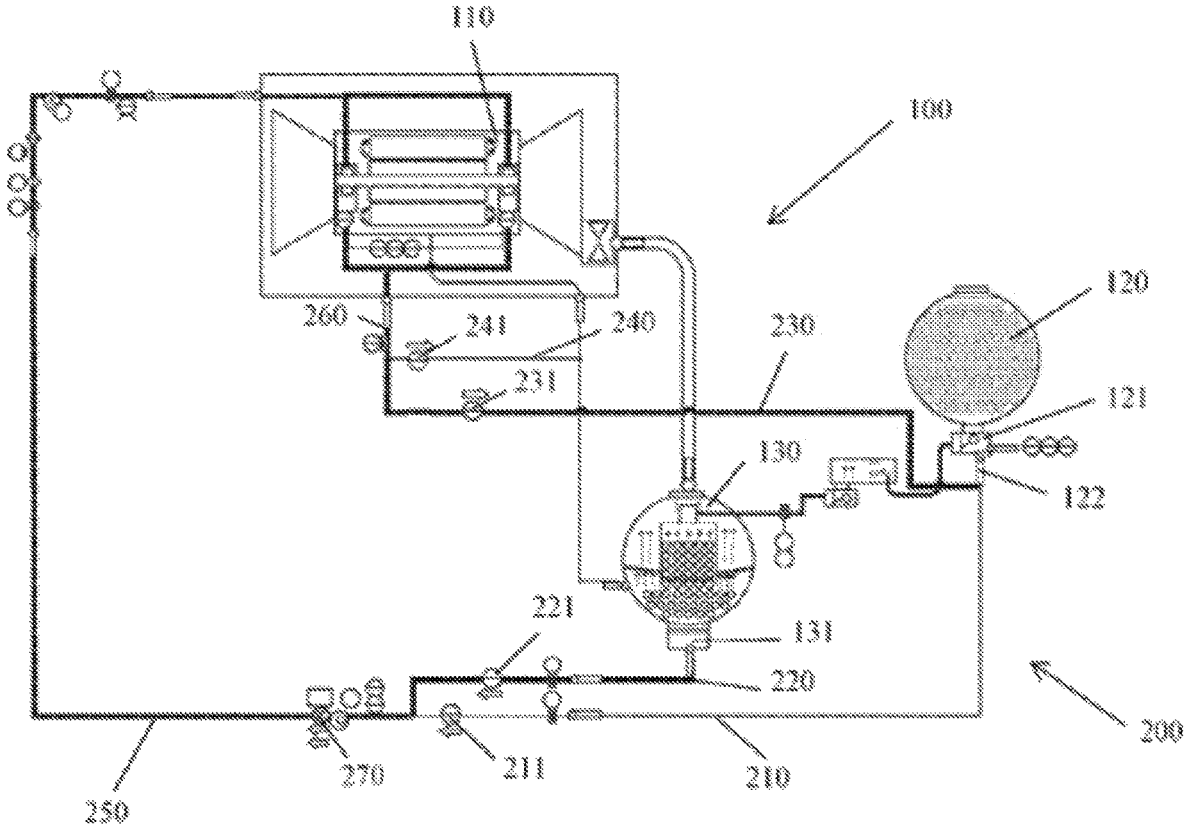
FIG. 2 is a schematic diagram of a flow path when a refrigeration system according to an embodiment of the present invention is executing a first lubrication mode.
Figure 3:
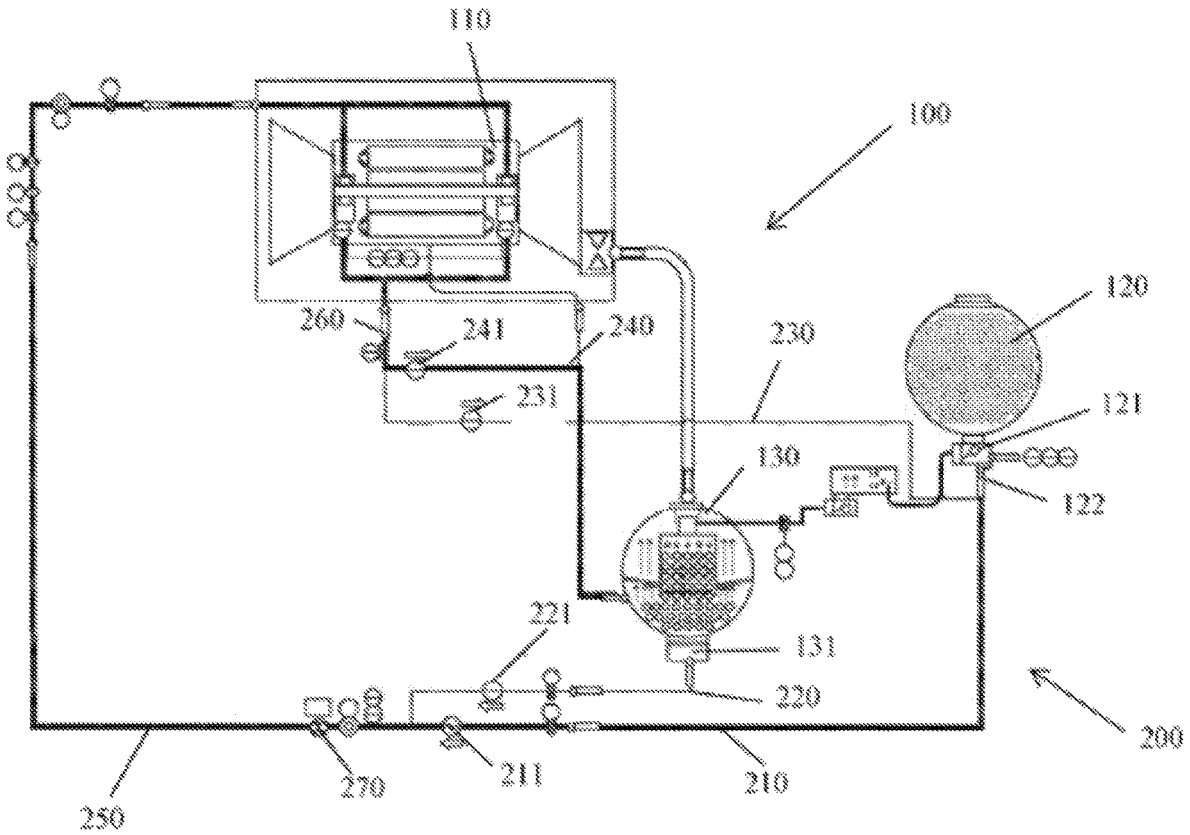
FIG. 3 is a schematic diagram of a flow path when a refrigeration system according to an embodiment of the present invention is executing a second lubrication mode.

Referring to FIG. 2 and FIG. 3, flow paths conducted in specific modes are shown by bold solid lines in the drawings. Several specific real-time working conditions are listed in the following to help describe a selection criterion of the first lubrication mode and/or the second lubrication mode. For ease of clear description, multiple real-time working conditions are defined here. For example, a power-up working condition refers to a situation in which the whole unit in a disconnected state is connected to a power supply. A start-up working condition refers to a situation in which power is supplied to the unit normally and the unit is started up. A running working condition refers to a situation in which the unit works normally. A stand-by working condition refers to a situation in which the unit stops running but the power supply is not interrupted. A chiller-off working condition refers to a situation in which the unit stops running and power supply is stopped.

In one situation, when the real-time working condition is the running working condition, the gaseous refrigerant is condensed in the condenser 120 in this case, and therefore the refrigerant accumulated in the liquid storage chamber 121 of the condenser 120 is mainly liquid. Thus, only an extremely small proportion of the refrigerant needs to be extracted to lubricate the bearing in the compressor, and the working performance of the refrigeration system is not affected at all. Therefore, the first lubrication mode can be employed.

In another situation, when the real-time working condition is any one of the power-up working condition, the standby working condition or the chiller-off working condition, the liquid refrigerant is mainly concentrated in the evaporator 130, and in this case, it is more convenient to extract the refrigerant from the evaporator 130 to lubricate the bearing in the compressor. Therefore, the second lubrication mode can be employed.

Specifically, when the real-time working condition is the power-up working condition, a termination condition of the control process may be further set as follows: execution of the second lubrication mode is stopped when a liquid level in the liquid storage chamber 121 of the condenser 120 is greater than a preset power-up liquid level value. In this case, the refrigerant in the liquid storage chamber 121 of the condenser 120 reaches a set amount, it also indicates that the refrigerant flowing through the bearing in the compressor reaches a set amount, and after the refrigerant of the set amount flows through the bearing in the compressor, the bearing in the compressor can be sufficiently lubricated in a power-up stage. Therefore, execution of the second lubrication mode can be stopped.

Further, more limiting conditions such as a time parameter can be introduced. Specifically, when the real-time working condition is the power-up working condition, execution of the second lubrication mode is stopped when the liquid level in the liquid storage chamber 121 of the condenser 120 is greater than the preset power-up liquid level value and execution duration of the second lubrication mode is greater than a first preset time value. In this case, in addition to the requirement on the amount of refrigerant flowing through the bearing in the compressor, a requirement is further posed on lubrication duration, to guarantee the lubrication effect thereof more accurately. As an example, the first preset time value may be 2 minutes.

Further, more control settings may be made in consideration of the presence of some abnormal situations. For example, when the real-time working condition is the power-up working condition, if the liquid level in the liquid storage chamber 121 of the condenser 120 is less than the preset power-up liquid level value and the execution duration of the second lubrication mode is greater than a second preset time value, it is found in this case that the refrigerant of the preset amount is still not achieved after a relatively long period of time, indicating that some problems may exist during the lubrication process. In this case, execution of the second lubrication mode is stopped. As an example, the second preset time value is 5 minutes.

Specifically, in the case where the real-time working condition is the standby working condition, as the standby working condition means that the device may start up at any time, the bearing in the compressor still needs to be in a relatively good lubrication state, for unexpected needs. Specifically, in the first case, an execution condition during the control process may further be set as follows: the second lubrication mode is executed when the liquid level in the liquid storage chamber 121 of the condenser 120 is less than a preset standby liquid level value. In this case, it means that the liquid amount in the liquid storage chamber 121 of the condenser is insufficient, and therefore requires supplement. And/or in the second case, an execution condition during the control process may further be set as follows: the second lubrication mode is executed at a first execution frequency when the liquid level in the liquid storage chamber 121 of the condenser 120 is greater than the preset standby liquid level value. In this case, it means that the liquid amount in the liquid storage chamber 121 of the condenser is sufficient, and a desirable lubrication state can be obtained only by performing periodic maintenance. As an example, the first execution frequency is executing the second lubrication mode for 5 minutes per hour. And/or in the third case, an execution condition during the control process may further be set as follows: the second lubrication mode is kept executed with a third preset time value when the liquid level in the liquid storage chamber 121 of the condenser 120 fluctuates about the preset standby liquid level value. In this case, it means that the liquid amount in the liquid storage chamber 121 of the condenser is unstable, and the condenser needs to be lubricated for a period of time to stabilize the lubrication state. As an example, the third preset time value is 5 minutes.

Further, more control settings may be made in consideration of the presence of some abnormal situations. For example, when the real-time working condition is the standby working condition, if the liquid level in the liquid storage chamber 121 of the condenser 120 is less than the preset standby liquid level value and execution duration of the second lubrication mode is greater than a fourth preset time value, it is found in this case that the refrigerant of the preset amount is still not achieved after a relatively long period of time, indicating that some problems may exist in the lubrication process. Execution of the second lubrication mode should be stopped. As an example, the fourth preset time value is 5 minutes.

Specifically, when the real-time working condition is the chiller-off working condition, as the chiller-off working condition means that the device may not start up again in a short time, and the device does not need to be lubricated for maintenance. However, it usually takes a period of time to shut down the device, and in this period of time, the bearing in the compressor is still lubricated at a decreasing speed; in this case, the bearing in the compressor still needs to be in a relatively good lubrication state. Therefore, the second lubrication mode should be executed with a fifth preset time value. As an example, the fifth preset time value is 2 minutes.

Specifically, when the real-time working condition is the start-up working condition, it is possible that most of the liquid refrigerant is still accumulated in the evaporator 130. Therefore, in this case, the second lubrication mode is executed with a sixth preset time value, to extract the liquid refrigerant from the evaporator 130 for lubrication. As an example, the sixth preset time value ranges from 0 to 30 seconds.

Further, after execution of the second lubrication mode, the system starts to be in a regular start-up working condition. In this case, the first lubrication mode is executed with a seventh preset time value, so that the refrigerant can return to the evaporator 130 to start working. As an example, the seventh preset time value ranges from 10 to 20 seconds.

As for how the refrigeration system in the foregoing embodiment realizes better balance between the lubrication effect and the working performance by reasonably using the aforementioned lubrication modes in the whole life cycle, in combination with the refrigeration system in FIG. 1 to FIG. 3, a complete manner of reasonably using the lubrication modes during the working process is further provided for reference.

First of all, after installation of a new refrigerating unit or after major maintenance, it is necessary to power up the unit again, which is usually accompanied with filling of the refrigerant into the maintained refrigerating unit for the first time. In this case, the second lubrication mode is usually executed to lubricate the bearing in the compressor, and the refrigerant after lubrication is enabled to flow into the condenser, to make sure that part of the refrigerant exists in the condenser in a subsequent unit start-up process. In this case, the refrigerant flows to the bearing in the compressor via the evaporator 130 and returns to the condenser 120, and this step is kept performed till the liquid level switch 122 in the liquid storage chamber 121 of the condenser 120 reaches a preset position and lubrication duration exceeds 2 minutes. The lubrication effect is guaranteed by using double standards: the liquid level switch and the lubrication duration.

Afterwards, if the refrigerating unit is not going to be used temporarily, it is maintained at a standby state. In this case, the second lubrication mode is usually executed to lubricate the bearing in the compressor, and multiple operation manners may be provided according to various possible situations in actual application. For example, when the liquid level switch 122 in the liquid storage chamber 121 of the condenser 120 does not reach the preset position, the second lubrication mode is kept executed to ensure a sufficient lubrication effect. For another example, after the liquid level switch 122 in the liquid storage chamber 121 of the condenser 120 reaches the preset position, to deal with the situation that the machine may start up at any time, the second lubrication mode should be executed for five minutes per hour, to maintain the lubrication effect of the bearing in the compressor. For another example, when the liquid level switch 122 in the liquid storage chamber 121 of the condenser 120 fluctuates about the preset position, it indicates that the liquid amount in the liquid storage chamber 121 of the condenser is unstable, and further charging is required. In this case, the second lubrication mode should be executed for another two minutes.

After that, if the refrigerating unit is planned to start up, the second lubrication mode may be executed for 30 seconds first, and then the first lubrication mode is executed for another 10 seconds, to bi-directionally confirm that the lubrication circuit can be used normally.

In addition, during a normal running period of the unit, as the refrigerant is condensed into liquid in the condenser, the first lubrication mode can be kept executed, to extract the liquid refrigerant from the condenser to lubricate the bearing in the compressor. Because the extracted liquid refrigerant accounts for an extremely small proportion in the total amount of the refrigerant, the normal working of the unit is not affected at all.

Furthermore, before the unit is stopped, it takes a period of time to shut down, and therefore lubrication cannot be stopped immediately, to avoid the bearing from being excessively abraded during the showdown process. Therefore, during shutdown of the unit, the second lubrication mode is kept executed for another 2 minutes.

The foregoing embodiment provides an exemplary description on how to select a lubrication mode during a full-period running process of the entire unit. It should be further noted that, when the first lubrication mode is executed, specific operations are as follows: the first control valve 211 and the fourth control valve 241 are turned on, and the second control valve 221 and the third control valve 231 are turned off. When the second lubrication mode is executed, specific operations are as follows: the second control valve 221 and the third control valve 231 are turned on, and the first control valve 211 and the fourth control valve 241 are turned off.

Figure 4:
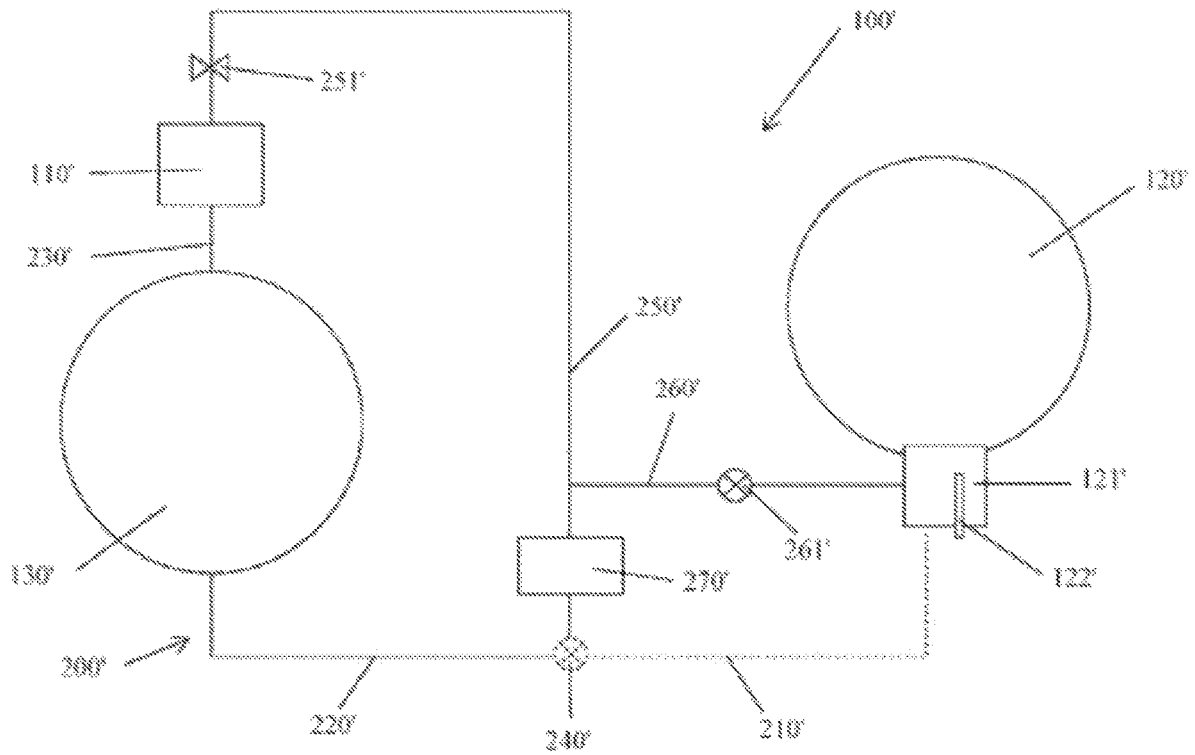
FIG. 4 is a schematic diagram of a flow path when a refrigeration system according to another embodiment of the present invention is executing a lubrication and pre-charging mode.

Referring to FIG. 4, according to another aspect of the disclosure, another refrigeration system 100' is further provided, including: a compressor 110', a condenser 120', an evaporator 130', and a lubrication circuit 200'. The lubrication circuit 200' includes a post-lubrication flow path connected from the compressor 110' to the evaporator 130'; and a pre-lubrication flow path connected from the condenser 120' and the evaporator 130' to the compressor 110' respectively. The lubrication circuit 200' can be partially conducted, so that after flowing from the condenser 120' via the pre-lubrication flow path to the compressor 110' for lubrication, a part of refrigerant for lubrication can flow back to the evaporator 130' via the post-lubrication flow path; or after flowing from the evaporator 130' via the pre-lubrication flow path to the compressor 110' for lubrication, the part of refrigerant for lubrication can flow back to the evaporator 130' via the post-lubrication flow path. In such an arrangement, the part of refrigerant can be selectively extracted from the evaporator 130' or the condenser 120' according to an actual situation, to lubricate a bearing in the compressor. According to the disclosure of this embodiment, the bearing in the compressor can be sufficiently lubricated in various real-time working conditions, so that the whole machine can run in a very smooth state, and the service life and working reliability thereof can be improved.

The pre-lubrication flow path and the post-lubrication flow path for guiding the refrigerant between the compressor 110' and a heat exchanger are mentioned in this embodiment.

Specifically, in the drawing, the pre-lubrication flow path includes a first branch 210' connected to the condenser 120' and a second branch 220' connected to the evaporator 130'; the post-lubrication flow path includes a third branch 230' connected to the evaporator 130'. The lubrication circuit 200' can be partially conducted, so that after flowing from the condenser 120' via the first branch 210' to the compressor 110' for lubrication, the part of refrigerant for lubrication can flow back to the evaporator 130' via the third branch 230'; or after flowing from the evaporator 130' via the second branch 220' to the compressor 110' for lubrication, the part of refrigerant for lubrication can flow back to the evaporator 130' via the third branch 230'.

Optionally, to achieve a lubrication effect on the bearing in the compressor by using two different refrigerant lubrication sources, separate on/off control over the two flow paths should be implemented. As the two share a common post-lubrication flow path, it is only necessary to control the pre-lubrication flow paths. Specifically, the first branch 210' and the second branch 220' are further provided with a first control valve and a second control valve for on/off control.

Optionally, the objective of implementing this idea does not necessarily require separate on/off control over multiple branches. From another aspect, it only requires that turning of branches can be implemented, a required flow path can be conducted, and a branch not required temporarily can be cut off. As an example meeting the foregoing requirement, the pre-lubrication flow path further includes a first common flow path 250' connected to the first branch 210' and the second branch 220' respectively, and a joint of the first branch 210', the second branch 220', and the first common flow path 250' is provided with a first three-way valve 240'.

Optionally, the refrigeration system 100' should further include a pre-charging branch 260', which is connected between the first common flow path 250' and a liquid storage chamber 121' of the condenser 120'; and a throttling element 251' is further provided downstream of the first common flow path 250' and the pre-charging branch 260'. The pre-charging branch 260' is used for providing a certain amount of refrigerant into the condenser 120' when the machine starts up for the first time and is powered on, to ensure smooth operation of the machine, and performing charging when a liquid level in the liquid storage chamber of the condenser is insufficient. To selectively conduct or turn off the pre-charging branch 260', the pre-charging branch 260' should be provided with a fifth control valve 261'.

Optionally, the refrigeration system further includes a driving component 270' provided on the pre-lubrication flow path, to provide a power source for extracting the refrigerant. It should be noted that, when the driving component 270' is provided on the first common flow path 250', only one driving component 270' needs to be provided to meet working requirements under different working conditions. When the driving component 270' is provided on a branch, at least one driving component 270' needs to be provided on each of the first branch 210' and the second branch 220' to meet requirements of driving different branches under different working conditions.

Optionally, on one hand, the first branch 210' is connected to a liquid storage chamber 121' of the condenser 120'. On the other hand, the second branch 220' is connected to a liquid storage chamber of the evaporator 130'; and the third branch 230' is connected to the bottom of the evaporator 130'. All these elements are located at the bottom of the condenser 120' or the evaporator 130', and such an arrangement can facilitate extraction of the liquid refrigerant.

Optionally, the refrigeration system further includes a filter assembly arranged on the pre-lubrication flow path, so as to filter out impurities in the refrigerant flowing through the path, and avoid affecting precision components in the compressor 110'.

Optionally, the refrigeration system further includes a liquid level switch 122' arranged in the liquid storage chamber 121' of the condenser 120', to provide monitoring data, thereby facilitating judging whether a current lubrication degree is applicable.

The lubricating method of the refrigeration system 100' shown in FIG. 4 is provided. One or more of the following lubrication modes are executed based on a real-time working condition. In a first lubrication mode, after flowing from the condenser 120' via the pre-lubrication flow path to the compressor 110' for lubrication, the part of refrigerant for lubrication is enabled to flow back to the evaporator 130' via the post-lubrication flow path; in a second lubrication mode, after flowing from the evaporator 130' via the pre-lubrication flow path to the compressor 110' for lubrication, the part of refrigerant for lubrication is enabled to flow back to the evaporator 130' via the post-lubrication flow path. In this case, it is determined, according to the actual amount of the liquid refrigerant in the evaporator 130' or condenser 120' in the real-time working condition, where to extract the liquid refrigerant to lubricate the bearing in the compressor.

Specifically, in a specific piping layout, the pre-lubrication flow path includes a first branch 210' connected to the condenser 120' and a second branch 220' connected to the evaporator 130'; the post-lubrication flow path includes a third branch 230' connected to the evaporator 130'. The first lubrication mode includes: enabling the part of refrigerant for lubrication to flow back to the evaporator 130' via the third branch 230' after flowing from the condenser 120' via the first branch 210' to the compressor 110' for lubrication; the second lubrication mode includes: enabling the part of refrigerant for lubrication to flow back to the evaporator 130' via the third branch 230' after flowing from the evaporator 130' via the second branch 220' to the compressor 110' for lubrication.

Figure 5:
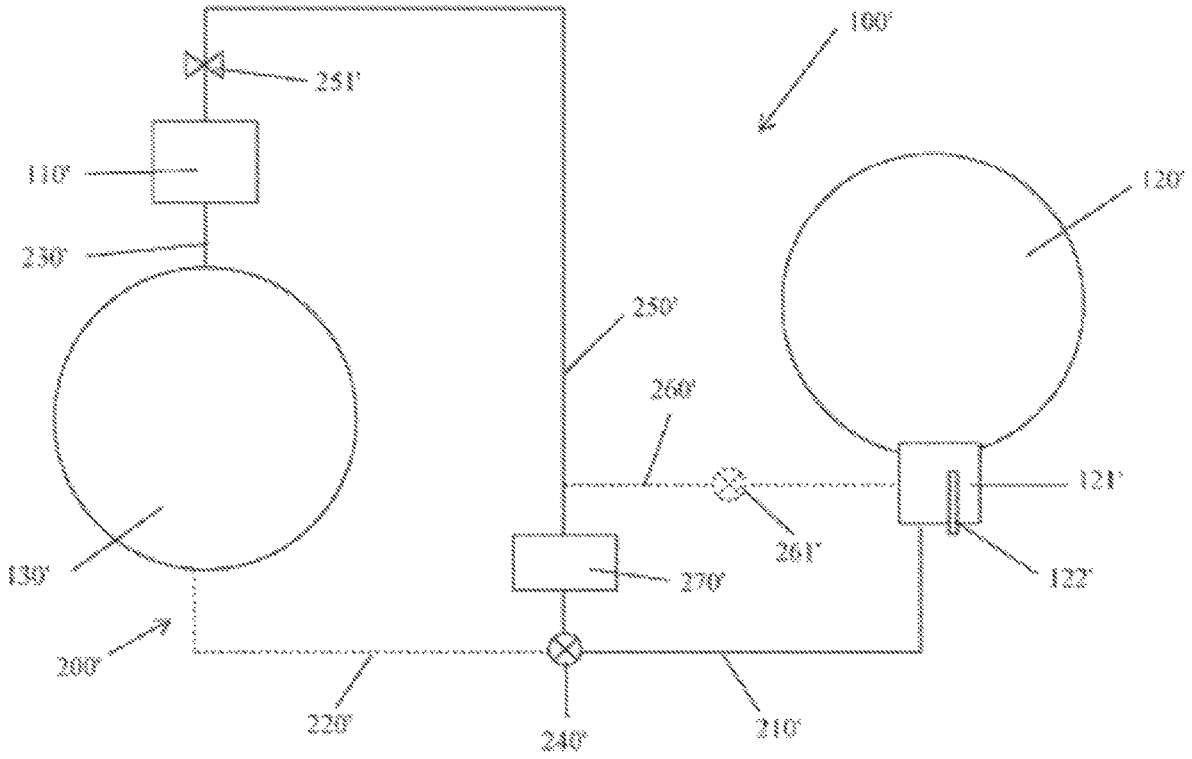
FIG. 5 is a schematic diagram of a flow path when a refrigeration system according to another embodiment of the present invention is executing a first lubrication mode.
Figure 6:
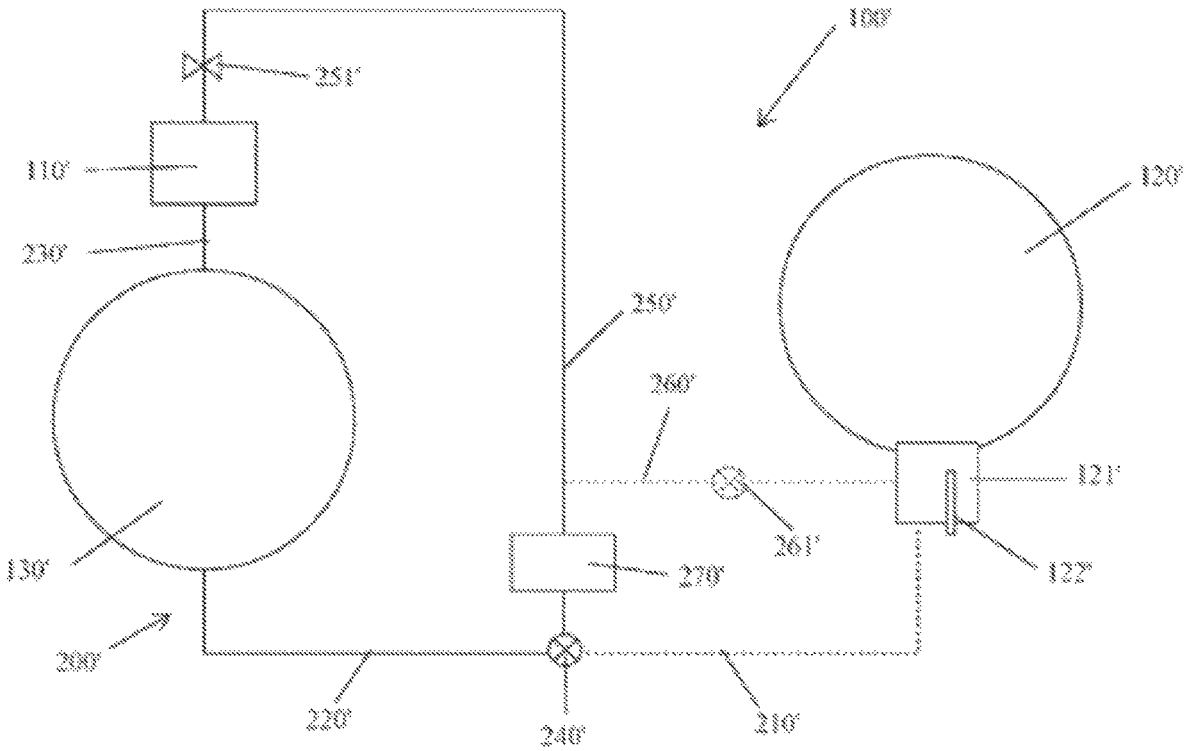
FIG. 6 is a schematic diagram of a flow path when a refrigeration system according to another embodiment of the present invention is executing a second lubrication mode.

Referring to FIG. 5 and FIG. 6, flow paths conducted in specific modes are shown by solid lines, and flow paths cut off in specific modes are shown by dotted lines in the drawings. Several specific real-time working conditions are listed in the following to help describe a selection criterion of the first lubrication mode and/or the second lubrication mode.

In one situation, when the real-time working condition is a running working condition, the gaseous refrigerant is condensed in the condenser 120' in this case, and therefore the refrigerant accumulated in the liquid storage chamber 121' of the condenser 120' is mainly liquid. Thus, only an extremely small proportion of the refrigerant needs to be extracted to lubricate the bearing in the compressor, and the working performance of the refrigeration system 100' is not affected at all. Therefore, the first lubrication mode can be employed.

In another situation, when the real-time working condition is either of a standby working condition or a chiller-off working condition, the liquid refrigerant is mainly concentrated in the evaporator 130', and in this case, it is more convenient to extract the refrigerant from the evaporator 130' to lubricate the bearing in the compressor. Therefore, the second lubrication mode is executed.

Referring to FIG. 4 again, a flow path conducted in a specific mode is shown by solid lines, and a flow path cut off in a specific mode is shown by a dotted line in the drawing.

In another type of situation, a lubrication and pre-charging mode is further included, so that a part of refrigerant flows from the evaporator 130' via the pre-lubrication flow path to the compressor 110' for lubrication, and then the part of refrigerant flowing into the compressor 110' for lubrication flows back to the evaporator 130' via the post-lubrication flow path; meanwhile, another part of refrigerant flows from the evaporator 130' via the pre-lubrication flow path to the condenser 120' for pre-charging. In this process, the presence of the throttling element 251' ensures that most of the refrigerant will flow into the condenser 120' for pre-charging, and only a relatively small amount of refrigerant will flow into the bearing in the compressor for lubrication.

This embodiment only differs from the foregoing embodiment in specific structures, and is the same as the foregoing embodiment in terms of the selection of the lubrication mode during a full running period of a unit. Therefore, reference may be made to the running mode selection principle in the foregoing embodiment, and the full running period of the unit is not described in detail again. In addition, for the execution frequency, duration, termination condition, and so on of the lubricating method of this embodiment in different modes, reference may be partially made to the specific parameter settings in the foregoing method, and details are not described herein again.

The foregoing examples mainly describe the refrigeration system and the lubricating method thereof in the present invention. Although only some implementations of the present invention are described, those of ordinary skill in the art should understand that the present invention may be implemented in many other forms without departing from the principle and scope thereof. Therefore, the illustrated examples and implementations are regarded as illustrative rather than limitative, and the present invention may cover various modifications and replacements without departing from the spirit and scope of the present invention defined by the appended claims.

What is claimed is:

1. A refrigeration system, comprising:

a compressor, a condenser, an evaporator, and a lubrication circuit, the lubrication circuit comprising a post-lubrication flow path connected from the compressor into the condenser and the evaporator respectively, wherein the lubrication circuit is distinct from a refrigeration circuit of the refrigeration system; and a pre-lubrication flow path connected from the condenser and the evaporator into the compressor respectively;

wherein the pre-lubrication flow path comprises a first branch connected to the condenser and a second branch connected to the evaporator respectively; and the post-lubrication flow path comprises a third branch connected to the condenser and a fourth branch connected to the evaporator, respectively;

the pre-lubrication flow path and the post-lubrication flow path are configured such that:

after flowing from the condenser via the first branch to the compressor for lubrication, a part of refrigerant for lubrication can flow back to the evaporator via the fourth branch;

and after flowing from the evaporator via the second branch to the compressor for lubrication, the part of refrigerant for lubrication can flow back to the condenser via the third branch.

2. The refrigeration system of claim 1, wherein the first branch, the second branch, the third branch and the fourth branch are provided with a first control valve, a second control valve, a third control valve and a fourth control valve respectively.

3. The refrigeration system of claim 1, wherein the pre-lubrication flow path comprises a first common flow path connected to the first branch and the second branch respectively, and the post-lubrication flow path comprises a second common flow path connected to the third branch and the fourth branch respectively.

4. The refrigeration system of claim 1, wherein the first branch and the third branch are connected to a liquid storage chamber of the condenser.

5. The refrigeration system of claim 1, wherein the second branch is connected to a liquid storage chamber of the evaporator; and the fourth branch is connected to the bottom of the evaporator.

6. The refrigeration system of claim 1, further comprising a liquid level switch arranged in a liquid storage chamber of the condenser.

7. A lubricating method of a refrigeration system, wherein the refrigeration system comprises a compressor, a condenser, an evaporator, and a lubrication circuit, wherein the lubrication circuit is distinct from a refrigeration circuit of the refrigeration system, the lubrication circuit comprising a post-lubrication flow path connected from the compressor into the condenser and the evaporator respectively; and a pre-lubrication flow path connected from the condenser and the evaporator into the compressor respectively, wherein the pre-lubrication flow path comprises a first branch connected to the condenser and a second branch connected to the evaporator respectively; and the post-lubrication flow path comprises a third branch connected to the condenser and a fourth branch connected to the evaporator respectively, wherein the method includes operating the lubrication circuit in a first lubrication mode and a second lubrication mode:

in the first lubrication mode, after flowing from the condenser via the first branch to the compressor for lubrication, a part of refrigerant for lubrication is enabled to flow back to the evaporator via the fourth branch; and in the second lubrication mode, after flowing from the evaporator via the second branch to the compressor for lubrication, the part of refrigerant for lubrication is enabled to flow back to the condenser via the third branch.

8. The lubricating method of a refrigeration system of claim 7, wherein, the first lubrication mode is executed in a running working condition.

9. The lubricating method of a refrigeration system of claim 7, wherein the second lubrication mode is executed in any one of a power-up working condition, a standby working condition or a chiller-off working condition.

10. The lubricating method of a refrigeration system of claim 9, wherein the execution of the second lubrication mode is stopped when a liquid level in a liquid storage chamber of the condenser is greater than a preset power-up liquid level value.

11. The lubricating method of a refrigeration system of claim 10, wherein the execution of the second lubrication mode is stopped when the liquid level in the liquid storage chamber of the condenser is greater than the preset power-up liquid level value and execution duration of the second lubrication mode is greater than a first preset time value.

12. The lubricating method of a refrigeration system of claim 11, wherein the first preset time value is 2 minutes.

13. The lubricating method of a refrigeration system of claim 11, wherein the execution of the second lubrication mode is stopped when a liquid level in a liquid storage chamber of the condenser is less than a preset power-up liquid level value and execution duration of the second lubrication mode is greater than a second preset time value.

14. The lubricating method of a refrigeration system of claim 13, wherein the second preset time value is 5 minutes.

* * * * *